US006921315B2

(12) United States Patent
Kownacki

(10) Patent No.: US 6,921,315 B2
(45) Date of Patent: Jul. 26, 2005

(54) TOY VEHICLE HAVING AN INTEGRAL PUMP ASSEMBLY

(75) Inventor: Charles D. Kownacki, Erie, PA (US)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 10/336,030

(22) Filed: Jan. 3, 2003

(65) Prior Publication Data

US 2003/0153239 A1 Aug. 14, 2003

Related U.S. Application Data

(60) Provisional application No. 60/344,054, filed on Jan. 3, 2002.

(51) Int. Cl.[7] ..... A63H 23/04
(52) U.S. Cl. ..... 446/162
(58) Field of Search ..... 446/37, 57, 161, 446/162, 176, 180, 186, 211

(56) References Cited

U.S. PATENT DOCUMENTS

| | | | | | |
|---|---|---|---|---|---|
| 819,653 | A | | 5/1906 | Hawke | |
| 1,479,163 | A | * | 1/1924 | Tyrrell | 446/186 |
| 1,994,202 | A | * | 3/1935 | Sarsfield | 446/186 |
| 1,994,842 | A | * | 3/1935 | Turner | 446/186 |
| 2,506,281 | A | * | 5/1950 | Sabini | 446/162 |
| 2,937,473 | A | * | 5/1960 | Vlachos | 446/37 |
| 2,987,848 | A | * | 6/1961 | Neuhaus et al. | 446/37 |
| 3,046,694 | A | * | 7/1962 | Holderer | 446/212 |
| 3,066,441 | A | | 12/1962 | Morse | |
| 3,739,520 | A | | 6/1973 | Hill, Jr. | |
| 3,924,350 | A | | 12/1975 | Hsu | 46/92 |
| 4,198,780 | A | | 4/1980 | Kubiatowicz | 46/92 |
| 4,448,409 | A | | 5/1984 | Kaga et al. | 272/8 N |
| 5,032,100 | A | * | 7/1991 | Goldfarb | 446/187 |
| 5,865,663 | A | | 2/1999 | Liao | 446/155 |
| 6,006,517 | A | | 12/1999 | Kownacki et al. | 60/370 |
| 6,280,277 | B1 | * | 8/2001 | Greenberg et al. | 446/161 |
| 6,398,613 | B1 | | 6/2002 | Rehkemper et al. | |

FOREIGN PATENT DOCUMENTS

| | | |
|---|---|---|
| GB | 1028789 | 5/1966 |
| WO | WO 5/01822 | 1/1995 |

* cited by examiner

*Primary Examiner*—John A. Ricci
(74) *Attorney, Agent, or Firm*—Bell Boyd & Lloyd

(57) ABSTRACT

An integral pump assembly may be used to power a toy vehicle. The pump pressurizes fluid stored within the pressure vessel. The pressurized fluid within the pressure vessel drives the engine that powers the toy vehicle until the stored pressurized fluid has been depleted. The pump may then repressurize the pressure vessel to again drive the pneumatic engine. The pump is substantially disposed within the body of the toy vehicle.

4 Claims, 8 Drawing Sheets

TOY VEHICLE HAVING AN INTEGRAL PUMP ASSEMBLY

CROSS-REFERENCE TO RELATED APPLICATION

This application claims the benefit under 35 U.S.C. § 119(e) of U.S. Provisional Application Ser. No. 60/344,054, filed Jan. 3, 2002, which is hereby incorporated by reference in its entirety.

FIELD OF THE INVENTION

The present invention relates to a toy vehicle. More particularly, the present invention relates to a toy vehicle having both an integral pump and vessel for powering an engine. Still more particularly, the present invention is for a toy submarine having an engine for powering the toy submarine, a vessel for storing fluid to drive the engine and a pump for supplying fluid to the vessel, each of which is integral with the toy submarine.

BACKGROUND OF THE INVENTION

Some existing toy vehicles having pneumatic engines have detachable pressure vessels for storing fluid. The pressure vessel is removed from a toy vehicle and pressurized by a separate pump. Once pressurized, the pressure vessel is reattached to the toy vehicle for powering the engine. Constant detaching and reattaching of the fluid pressure vessel can lead to degradation of the joint between the pressure vessel and the toy vehicle. A poor joint between the pressure vessel and the toy vehicle leads to a loss of pressurized fluid within the pressure vessel, which results in a less powerful engine. When the joint has deteriorated sufficiently, the entire toy vehicle must be replaced to attain the same degree of performance as when the toy vehicle was new. Moreover, since the pressure vessel is detachable, it is easily lost or misplaced. Without the pressure vessel, the toy vehicle is inoperable and the missing vessel must be replaced.

Other existing toy vehicles have integral fluid pressure vessels, but still require a separate pump to pressurize the pressure vessel. The pump is connected to the pressure vessel to pressurize the pressure vessel. The pump must be disconnected from the pressure vessel to use the toy vehicle. Therefore, one must remember to bring the corresponding pump for the toy vehicle or the pressure vessel cannot be pressurized, which results in the toy vehicle being inoperable. Furthermore, repeatedly connecting and disconnecting the pump to and from the pressure vessel can lead to degradation of the connection between the pump and pressure vessel, thereby increasing the difficulty of pressurizing the pressure vessel. Once the joint has deteriorated sufficiently, the entire toy vehicle must be replaced to attain the same degree of performance as when the toy vehicle was new. As with the detachable vessel, the pump may be easily misplaced or lost, again resulting in the toy vehicle being inoperable and requiring replacement of the pump.

Thus, there is a continuing need to provide improved toy vehicles having integral pumps and pressure vessels.

SUMMARY OF THE INVENTION

The present invention relates to a toy vehicle having an engine that is powered by a pump and a pressure vessel, which are both integral with the toy vehicle. The integral pump selectably supplies fluid to the pressure vessel. The integral pressure vessel is in fluid communication with the engine to provide pressurized fluid to power the engine.

Accordingly, it is a primary object of the present invention to provide a toy vehicle having an engine, vessel and pump that are all integral with the toy vehicle. By providing a toy vehicle having an integral vessel and pump, the degradation of joints between the engine and vessel and between the vessel and pump is eliminated. Additionally, because the vessel and pump are integral with the toy vehicle, loss or misplacement of the vessel and pump is avoided.

The foregoing objects are basically attained by providing a toy vehicle having an engine for powering the toy vehicle, a vessel integral with the toy vehicle for storing fluid to drive the engine, and a pump integral with the toy vehicle for supplying fluid to the vessel.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings that form a part of the original disclosure:

FIGS. 2A through 2C are sequential conceptual views showing the principles of co-action of the cam connecting rod and piston, in which FIG. 2B is taken along line 2B—2B of FIG. 1;

DETAILED DESCRIPTION OF THE INVENTION

Figure 10:
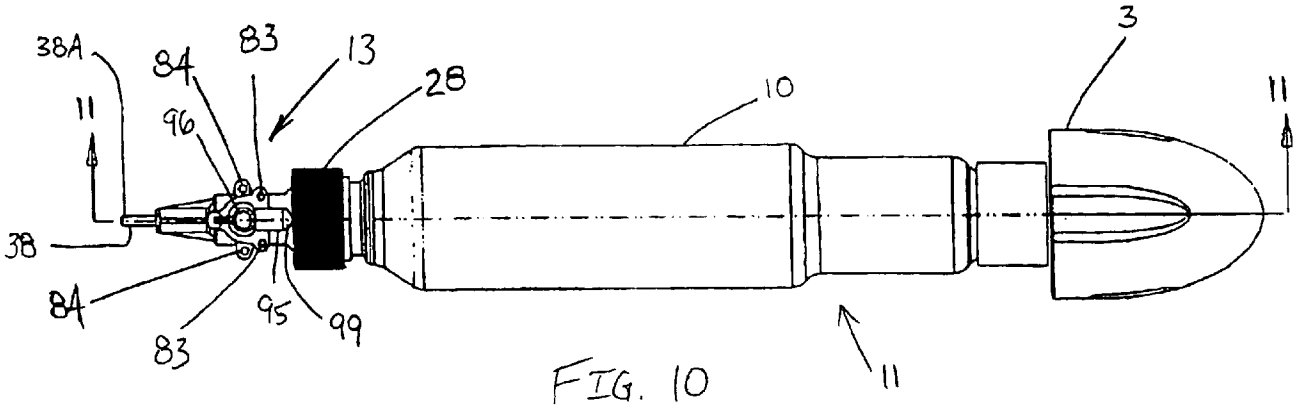
FIG. 10 is a top view of an integral pump, vessel and engine assembly according to the present invention.
Figure 11:
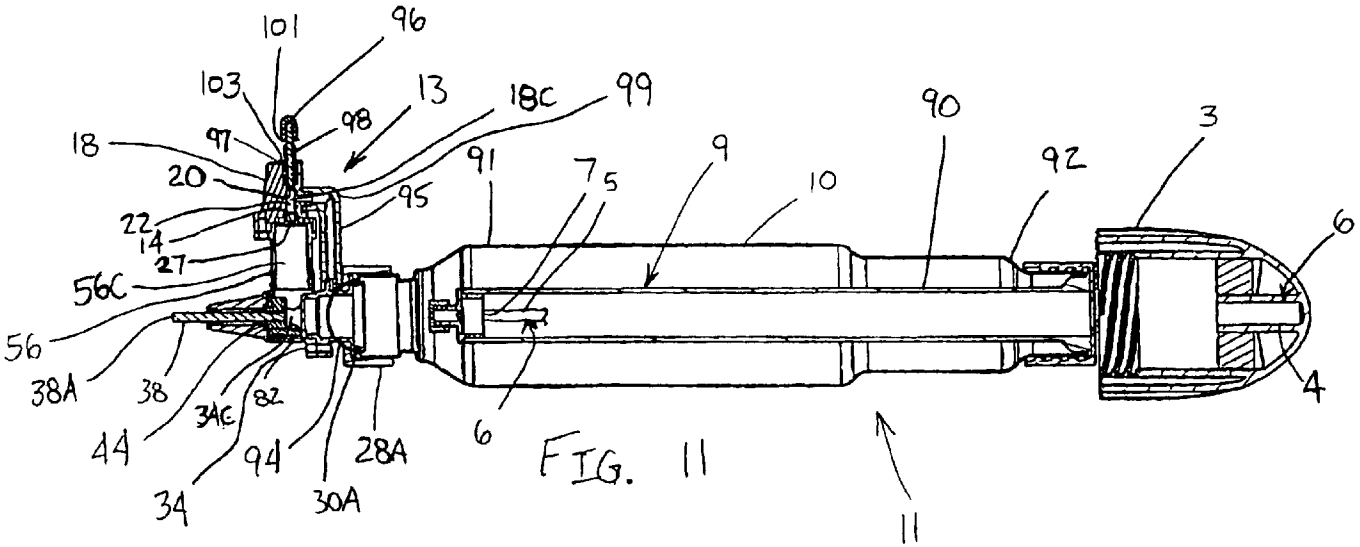
FIG. 11 is a cross section taken along line 11—11 of FIG. 10 of the integral pump, vessel and engine assembly of the present invention.
Figure 12:
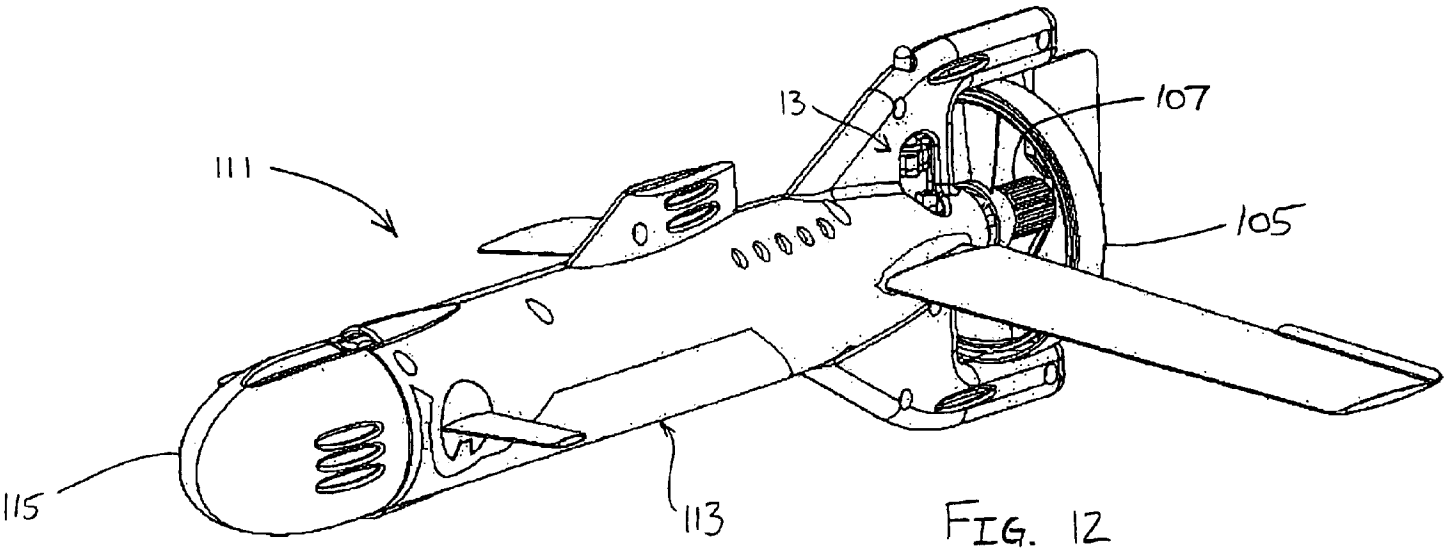
FIG. 12 is a perspective view of a toy submarine having the integral pump, vessel and engine assembly of the present invention showing the pump handle in a first position.
Figure 13:
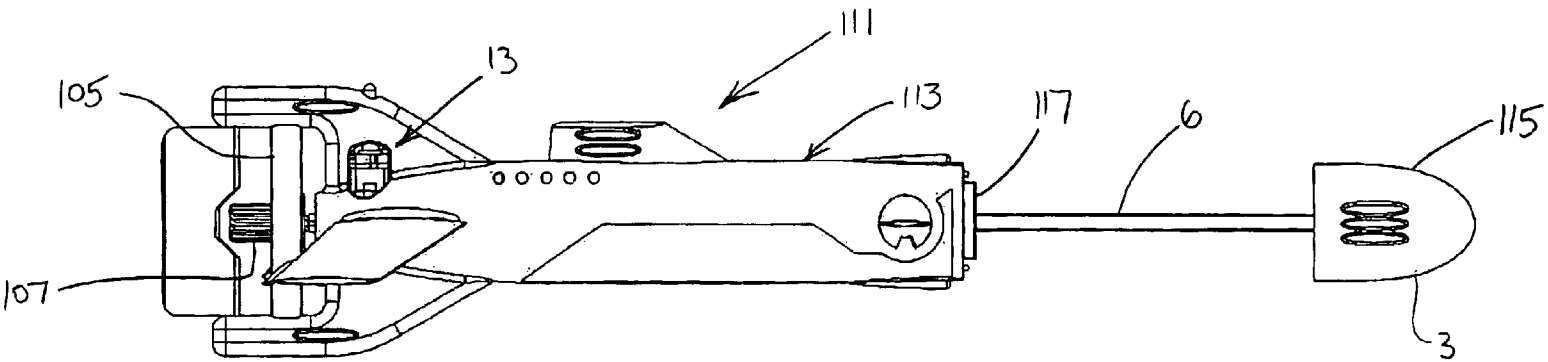
FIG. 13 is a side elevational view of the submarine of FIG. 12 showing the pump handle in a second position.

The present invention relates to a toy vehicle 11 having an engine 13 that is powered by a pump 9 and pressure vessel 10 that are both integral with the toy vehicle, as shown in FIGS. 10–13. Preferably, the engine is a pneumatic engine. The toy vehicle may be a submarine 111, as shown in FIGS. 12 and 13, or a plane (FIG. 9) or car, but is not limited to such embodiments.

A selectably pressurizable vessel 10 is shown in FIGS. 10 and 11. Preferably, pressure vessel 10 is made of a resilient polymeric plastic bottle. In one embodiment of the invention, the pressure vessel 10 has a capacity of about 2.5 liters with the range thereof preferably being between two and three liters. The pressure vessel 10 is integral with the toy vehicle. Preferably, the pressure vessel 10 is substantially disposed within the housing 113 of toy vehicle 11, as shown in FIGS. 12 and 13. Preferably, the housing (hull) 113 of the toy submarine 111 completely encloses the pressure vessel 10.

Pressure vessel 10 is pressurized by a pump 9 that is integral with the toy vehicle 11, as shown in FIGS. 10–13. Preferably, the pump 9 is substantially disposed within pressure vessel 10. The pump 9 includes a pump housing or cylinder 90 and a piston 7 axially movable within the pump cylinder. Piston 7 is positioned at a first end 5 of a rod 6. A pump handle 3 is connected to the second end 4 of rod 6. Preferably, the pump handle 3 forms a portion of the toy vehicle housing, such as a nose 115 of a toy submarine 111 as shown in FIGS. 12 and 13. Preferably, pump cylinder 90 is substantially disposed within pressure vessel 10, as shown in FIG. 11. Drawing the pump handle 3 outward relative to the pressure vessel 10, as shown in FIG. 13, moves piston 7 to a second end 92 of pump cylinder 90, thereby filling the pump cylinder with fluid. Pushing pump handle 3 inward relative to pressure vessel 10 moves piston 7 back to a first end 91 of pump cylinder 90, as shown in FIG. 11, thereby pushing fluid out of pump cylinder 9 and into pressure vessel 10, thereby supplying fluid to the pressure vessel and increasing the pressure of the fluid within the pressure vessel.

As shown in FIG. 13, the nose 115 of the toy submarine 111 is the pump handle 3. When the pump handle 3 is in the position shown in FIG. 13, the piston 7 is at the second end 92 of pump cylinder 90. Moving the nose 115 between the first and second positions shown in FIGS. 12 and 13, which correspond to the piston being at the first end 91 and second end 92 of pump cylinder 90, respectively, supplies fluid to vessel 10, which pressurizes the vessel. When the pressure vessel is pressurized to a desired level, the nose 115 is secured to rim 117 of housing 113 to prevent further pressurizing the pressure vessel. Any suitable manner of securing the nose to the rim may be used. Preferably, a tongue and groove locking means is used, where a tongue (not shown) on the inner surface of the nose 115 is locked into a groove (not shown) on the outer surface of rim 117. Additional locking means may be used to provide a more secure closure between the nose 115 and the rim 117 of the hull 113 of the toy submarine 111.

In a preferred embodiment, the toy vehicle is a toy submarine 111, as shown in FIGS. 12 and 13. The housing forms the hull 113 of the toy submarine 111. The pump, vessel and engine 13 are all integral with the toy submarine 111, and are substantially disposed within the hull 113 of the submarine. The nose 115 of the submarine is the pump handle, which forms the foremost portion of the submarine hull 113. The nose 115 is rotated to unlock it from the rim 117 of the hull 113. Repeatedly moving the nose away from and back toward the hull pressurizes the pressure vessel 10. Once the pressure vessel 10 has been sufficiently pressurized, the nose is reattached to the hull and rotated to a locking position with the hull. The toy submarine is then ready to be operated without having to detach the pump from the toy submarine or to attach the vessel to the toy submarine. In a preferred embodiment, the user simply imparts a quick spin to the propeller 105 to initiate supplying fluid from the vessel 10 to the engine 13 to drive the toy submarine. The rotation of the propeller 105, which is connected to the piston spring 70 as described below, causes the piston spring to unseat second ball 14, thereby initiating an engine cycle, which is described in more detail below.

Passageway 95 connects pressure vessel 10 to engine 13, as shown in FIG. 11. Preferably, the engine is a pneumatic engine, which, preferably, is similar to the engine described in U.S. Pat. No. 6,006,517 to Kownacki, which is hereby incorporated by reference in its entirety. The engine shown in FIGS. 10 and 11 is identical to that shown in FIGS. 1–9, except for the passageway between the vessel and the engine. In FIGS. 1–9, a straight passageway 24 runs between the vessel 10 and the engine 13. In FIGS. 10 and 11, the passageway 95 has a 90 degree elbow 99 between the vessel and the engine. As pressure vessel 10 is pressurized, passageway 95 and intake chamber 18C are also pressurized at the same time, as they are in fluid communication with one another.

Figure 4:
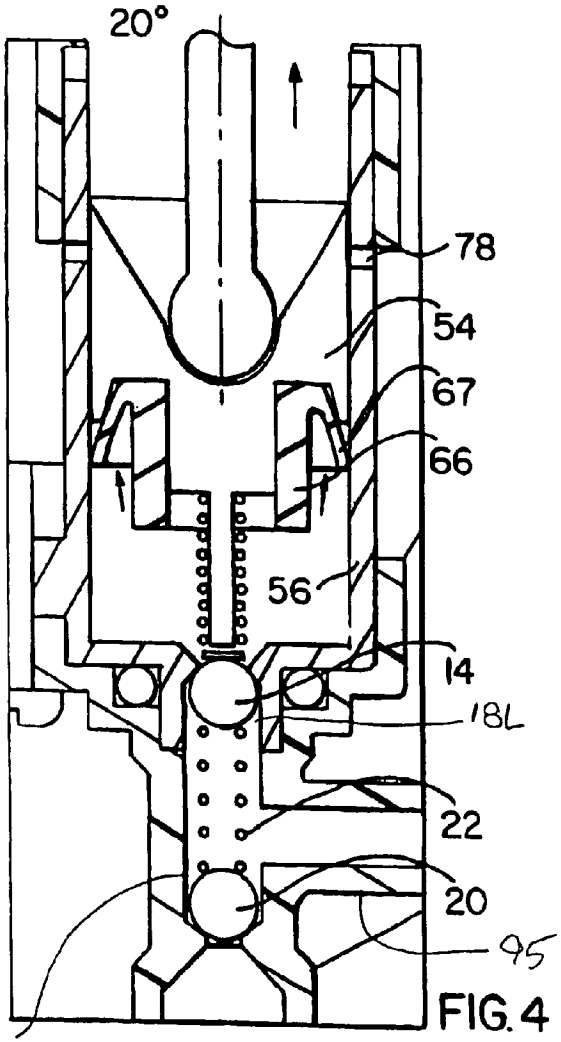
FIG. 4 is a view sequential to that of FIG. 1A showing the piston and connecting rod location at a twenty degree position relative to the fixed engine bracket.
Figure 3:
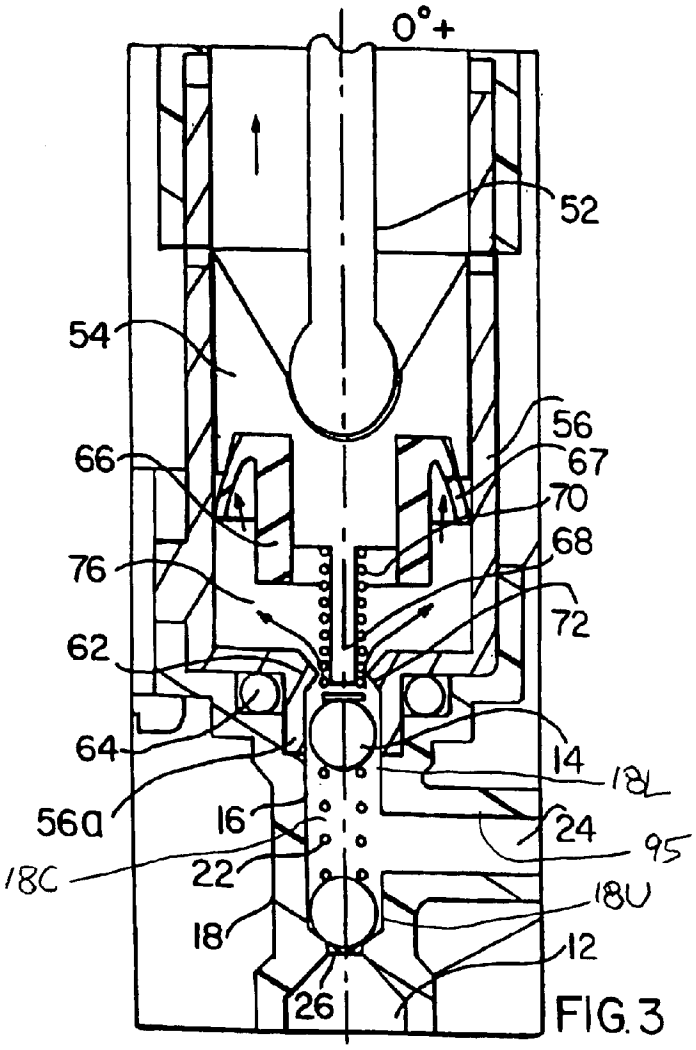
FIG. 3 is a partial cross section view of FIG. 1 showing the piston, connecting rod, cylinder and intake chamber of the pneumatic engine.
Figure 6:
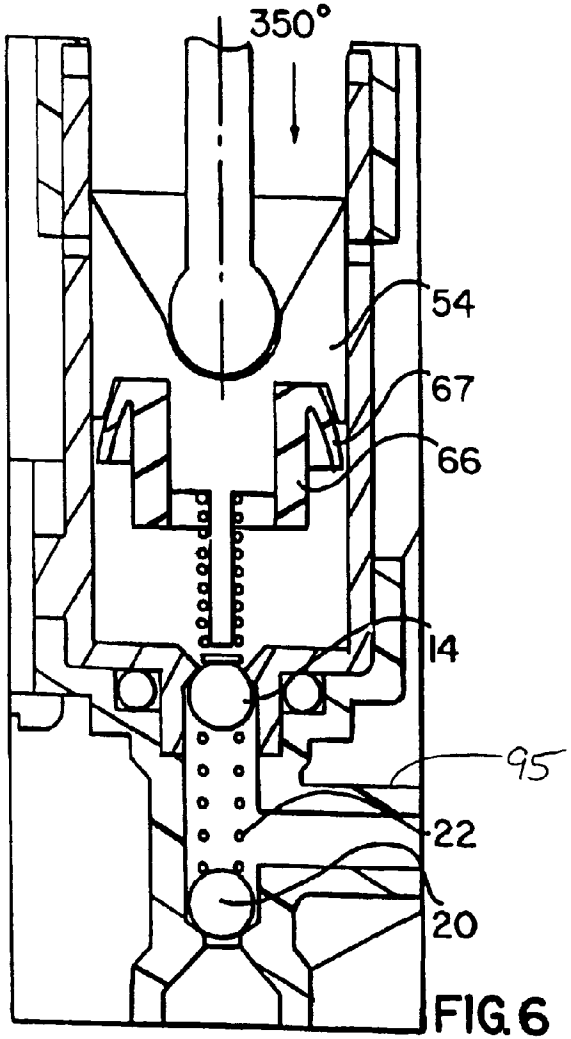
FIG. 6 is a schematic view sequential to the views of FIGS. 3 to 5 showing the cam at a rotational position of about 350 degrees.

Intake chamber 18C has an upper end 18U and a lower end 18L, as shown in FIGS. 3, 4 and 11. A first ball 20 is situated at the upper end 18U of intake chamber 18C to seal first outlet (relief) 26. A second ball 14 is positioned in a second outlet that connects intake chamber 18C to piston chamber 56C. First and second balls 20 and 14, respectively, are connected by a spring 22. The pressure vessel 10 is filled with pressurized fluid by pumping the handle 3. The build up of pressure in intake chamber 18C forces first ball 20 and second ball 14 to move axially in opposite directions, which creates tight seals with first and second outlets 26 and 27, respectively. Spring 22 may be compressed by pressing button 96 to permit passage of air or any other fluid through first outlet 26, as shown in FIGS. 10 and 11. Button 96 is not shown in FIGS. 3 and 4.

Button 96 may be used to relieve pressure from the pressure vessel 10, or to drain any water or other unintended fluid that may have entered engine 13 while using toy vehicle 11. Depressing button 96 moves rod 97 axially downward, as shown in FIG. 11, thereby moving first ball 20 downward and compressing spring 22. This opens first outlet 26, thereby relieving air, water or any other fluid that has entered any part of the engine 13 and pressure vessel 10, including passageway 95 and intake chamber 18C. Except when moved by depressing button 96, first ball 20 seals first outlet 26 of the intake chamber 18C, thereby providing a tight fluid seal of the compressed fluid in pressure vessel 10. Spring 98 is positioned on rod 97 between upper surface 103 of intake chamber 18C and lower surface 101 of button 96. Depressing button 96 to open first outlet 26 moves lower surface of button 96 downward, thereby compressing spring 98 between the lower surface of the button and the upper surface of the intake chamber. Releasing button 96 causes spring 98 to expand, thereby moving button 96 back to its normal operating position, thereby moving rod 97 upward and expanding spring 22 such that it no longer prevents first ball 20 from sealing first outlet 26.

The intake chamber 18C is connected to the pressure vessel 10 by passageway 95, as shown in FIGS. 10 and 11.

One end 94 of passageway 95 is connected to one side of pressure vessel cap 28. Neck 29 of pressure vessel 10 is connected to the other side of pressure vessel cap 28. Preferably, passageway end 94 and pressure vessel neck 29 are externally threaded to thread into internally threaded pressure vessel cap 28. Provided between the pressure vessel neck 29 and the cap 28 and between the passageway end 94 and the cap 28 are circumferential elastomeric gaskets 30 and 30A, respectively.

Passageway end 94 and cam chamber housing 34 of the engine 13 are secured together with a mounting screw 82. The intake chamber housing 18 is connected to piston chamber housing 56 by mounting screws 83. Piston chamber housing 56 is connected to cam chamber housing 34 by mounting screws 84. Mounting screws 82, 83 and 84 facilitate maintaining alignment of shaft 38 by keeping engine 13 stationary, especially since large forces impacting into and perpendicular to the centering of the shaft axis are common during normal usage. The cap 28 eliminates vibration and impact forces during normal usage of the vehicle. In addition to making chamber housings 18, 56 and 34 and passageway 95 unitary, mounting screws further prevent any excessive movement between parts.

A main engine shaft 38 is connected to a cam 44, as shown in FIGS. 1, 2A, 2B, 2C and 11. Further, through bearings 40 and 42 attached to the main shaft 38, the main shaft 38 is rotationally secured to cam 44 within cam chamber housing 34. Accordingly, cam 44 rotates within cam chamber housing 34, thereby rotating main shaft 38. Cam 44 is connected to a cam shaft 46. Connecting rod 52 connects cam shaft 46 to a piston 54.

A propeller 105 is connected to a first end 38A of main shaft 38. A hub 107 is connected to propeller for imparting motion to the propeller by a user of the toy vehicle.

Figure 1:
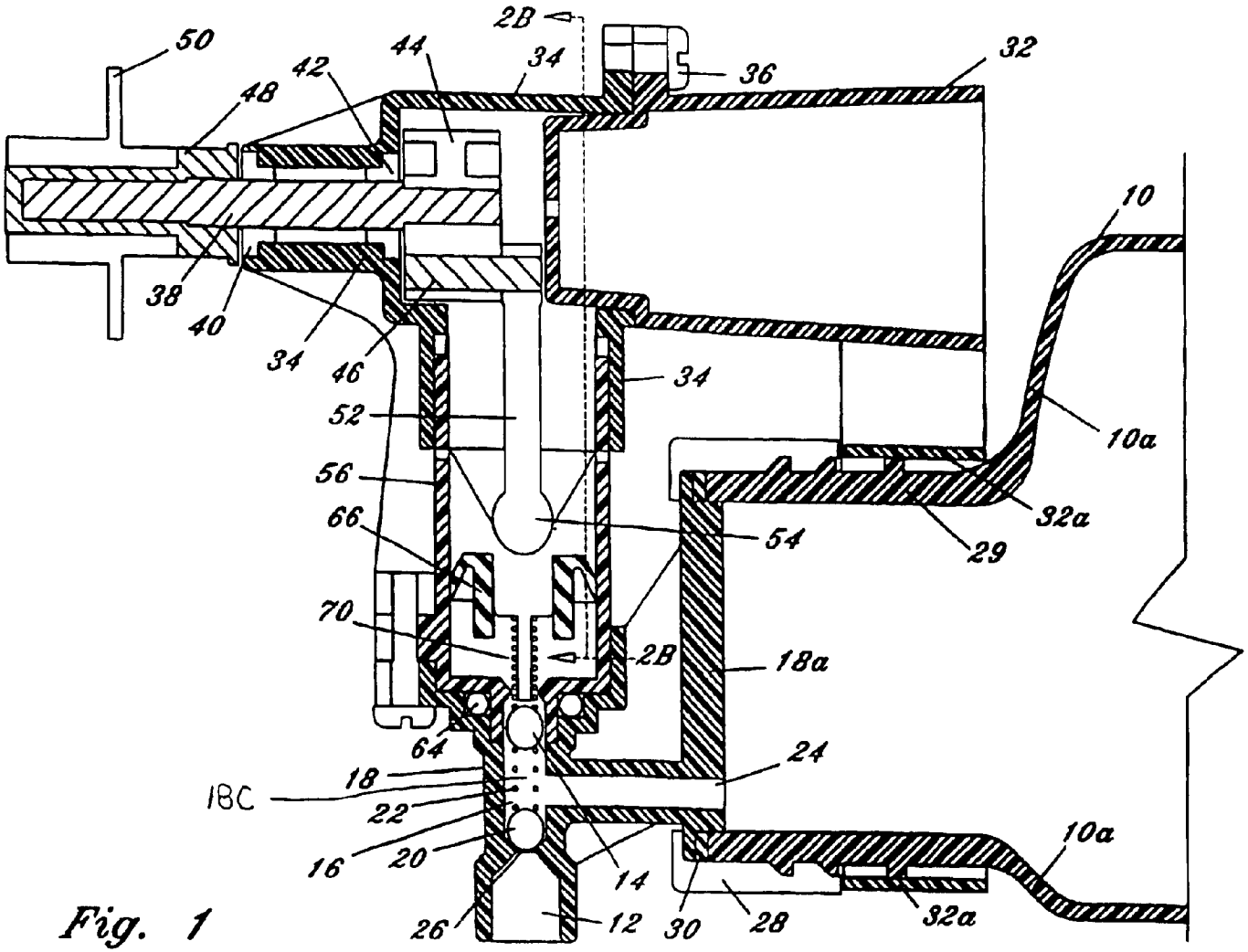
FIG. 1 is cross sectional view taken through the longitudinal centers of the main engine shaft, connecting rod, and piston of a pneumatic engine, in which the cam is at a zero degree position.

The position of cam shaft 46 relative to the cam chamber housing 34, as shown in FIG. 1, is herein referred to as the zero degree position of the cam. At this rotational position of the cam 44 and cam shaft 46, connecting rod 52 and piston 54 are at their lowest, that is, distal-most position relative to the main shaft 38 of the system. The operation of cam 44 and connecting rod 52 relative to piston 54 may be more fully appreciated with reference to the sequential views of FIGS. 2A, 2B and 2C. These figures comprise radial cross-sectional views taken in the direction of Line 2B—2B of FIG. 1. The position of the engine of FIG. 1 shown in FIG. 2B, is the point of greatest extension of connecting rod 52 and piston 54 relative to the main engine shaft 38 upon which cam 44 rotates.

Figure 2C:
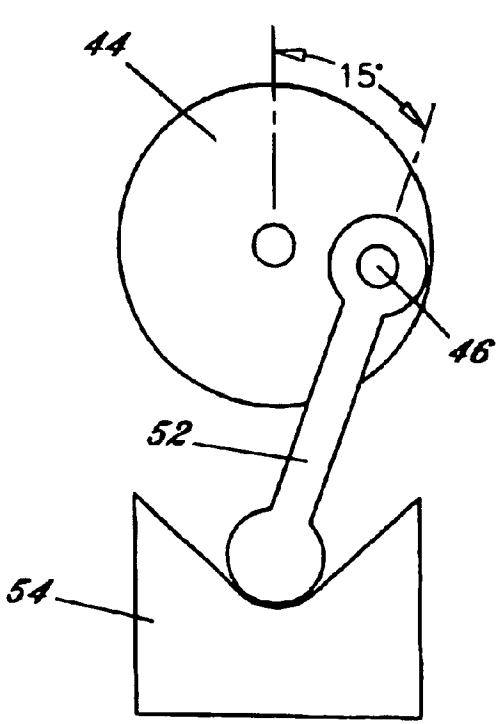
Figure 2B:
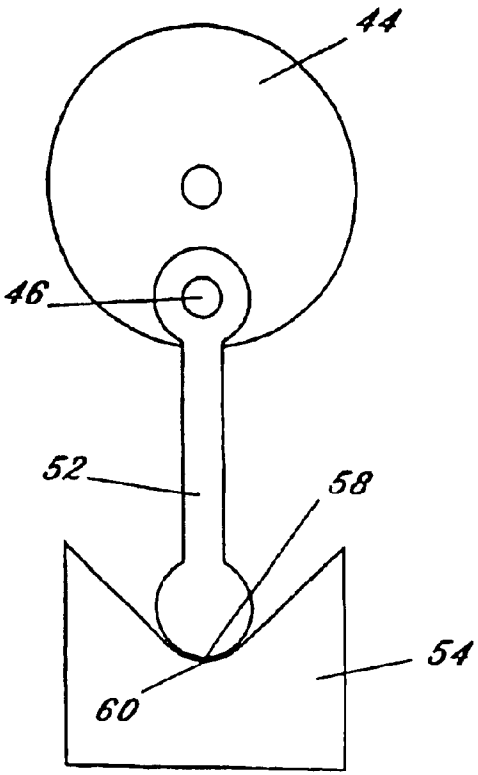
Figure 2A:
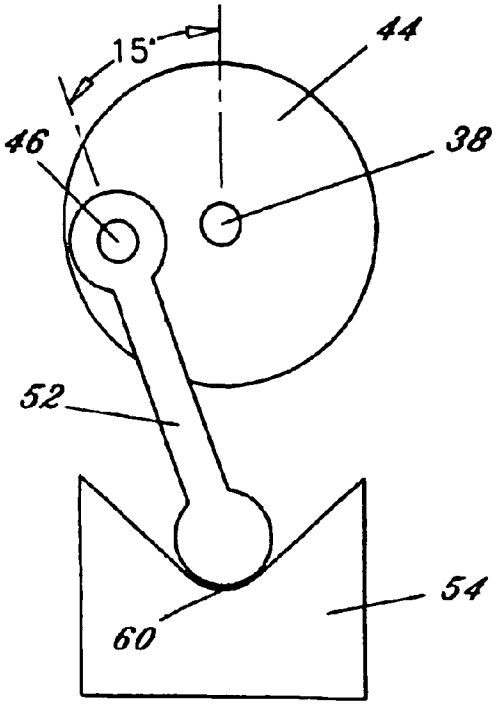

FIG. 2A shows a position of the connecting rod 52 relative to the zero position of FIG. 2B that is 15 degrees before the zero position. As such, the position is the 345 degree position, that is, a downstroke position of the engine, while the position of the connecting rod 52 and cam 44 shown in FIG. 2C is the 15 degree, that is, an upstroke position of the engine. The significance of these rotational cam positions is further set forth below.

Engine cylinder housing includes a cam chamber housing 34 and a piston chamber housing 56. The piston chamber 56C is in fluid communication with the intake chamber 18C through second outlet 27. The piston chamber 56C is seated upon a sealing O-ring 64, which thereby sits upon the intake chamber 18C.

By virtue of a piston seal 66 and a circumferential integral skirt 67, which are more fully described in U.S. Pat. Nos. 6,085,631 and 6,230,605 ("Piston-to-Cylinder Seal for a Pneumatic Engine") to Kownacki, both of which are hereby incorporated by reference in their entirety, piston 54 is slidably mounted along a longitudinal axis of the piston chamber 56C and assures a substantially fluid tight relationship between the piston and the internal circumferential walls of the piston chamber housing 56, as shown in FIG. 3.

The piston 54 includes an axial member 68 which projects distally toward the second outlet 27 of the intake chamber 18C and is proportioned in diameter for insertion thereunto. Mounted about said axial member 68 is a piston spring 70 having an outside diameter that is barely sufficient to clear the outlet 27 and having a length sufficient to effect selectable contact with the second ball 14 that seals the second outlet 27 of the intake chamber 18C. Spring 70 extends further axially than axial member 68 on which the spring is mounted.

As shown in FIGS. 3–8, as piston 54 moves downward within piston chamber 56C, the spring 70 contacts second ball 14, which prior to such contact seals second outlet 27 due to pressurized air in intake chamber 18C. As spring 70 contacts second ball 14, the ball does not move since the downward force due to the spring coefficient of spring 70 is less than the combined force generated by the spring coefficient of spring 22 plus the force of the pressurized air in intake chamber 18C. Prior to contact by spring 70, second ball 14 is held against conical surface of outlet 27 by the air pressure against the intake chamber side of second ball 14 from the pressure vessel 10 passing through passageway 95 and intake chamber 18C. This is the condition that is shown in the views of FIGS. 4 through 7, more fully described below. Accordingly, only in the condition shown in FIGS. 1, 2B, 3 and 8, that is, in which the cam is at a zero degree position, that is, a maximum piston rod stroke extension, will the spring force of piston spring 70 and the force of the piston 54 on the piston chamber side of second ball 14 overcome the combined force of valve spring 22 and the force of intake chamber air pressure on second ball 14. Thus, spring 70 compresses against the piston chamber side of second ball 14 until the additional force of the axial member 68 pushing against the piston chamber side of second ball 14 overcomes the forces on the intake chamber side of second ball 14, thus unseating second ball 14 from outlet 27.

The length of time that the second ball 14 remains unseated from second outlet 27 is extended by choosing a greater spring constant for spring 70 than for spring 22. As the pressure is equalized between intake chamber 18C and piston chamber 56C, since the spring constant of spring 70 is greater than the spring constant of spring 22, spring 70 extends further axially by the axial length of the spring beyond the end of axial member 68. This lengthens the amount of time in which high pressure air flows into piston chamber 56C, thereby creating a more powerful engine. Furthermore, since second ball 14 is unseated when the piston 54 is at the bottom of its stroke, back pressure in the piston chamber 56 is eliminated.

This force is calculated by multiplying the air pressure from the pressure vessel 10, that is, approximately 100 pounds per square inch, times the area of the housing inlet 62, which has a diameter of about 1.7 millimeters. Thereby, the force necessary to accomplish closure of ball 14 against conical surface 72 and inlet 27 is 0.332 pounds, which is about 151 grams of force. Such opening of second ball 14 is only accomplished at the lowest point of the cam stroke, that is, the zero degree position shown in FIGS. 1, 2B, 3 and 8. Further, since spring 70 is only about one millimeter longer than the minimum distance required to open ball 14, only the downward-most position of piston 54 and, with it, of axial member 68 will effect an opening of the ball 14 relative to conical surface 72 of only one millimeter (in vertical linear terms), thereby allowing air to pass about the sides of ball 14 and into the piston chamber housing 56. This process enables air to pass about the spring 70 and through inlet 27 as is indicated by arrows 76 in FIG. 3. As this occurs, air pressure quickly equalizes around ball 14 to create high pressure within the lowermost part of the piston chamber housing 56, thus initiating the upward stroke of the piston 54 and connecting rod 52, causing skirt 67 of piston seal to expand radially against walls of said housing 56.

It is noted that an important function of spring 70, accomplished by careful selection of the spring force thereof, is that the expansion of spring 70 against second ball 14, prior to air pressure equalization about the ball permits a longer interval of compressed air from the pressure vessel to enter the lowest part of the cylinder, than that existent in prior art compressed air engines. This results in a more powerful engine stroke. Further, by selection of a suitable spring constant, spring 70 will expand powerfully against ball 14 upon the initiation of the pressure stroke. The same is represented by the transition in piston positions shown between the zero degree cam position of FIG. 3 and the 20 degree cam position of FIG. 4, in which skirt 67 remains flush with the walls of housing 56, thereby assuring high pressure within said housing during the FIG. 4 phase of the engine stroke. It is, accordingly, to be appreciated that the view of FIG. 3 represents both completion of a downward stroke and the initiation of an upward stroke.

The beginning of the upward motion of piston 54 is shown in FIG. 4, this corresponding to the twenty-degree position of the cam. Therein, high pressure within piston chamber 56C moves the piston 54 upward and, with it, connecting rod 52, thus furthering the rotation of cam 44 and, with it, main shaft 38. As piston 54 moves upward, there is no force exerted on the piston chamber side of second ball 14. Thus, the force created on the intake chamber side of second ball 14 by the high pressure air within intake chamber 18C and the spring constant of spring 22 overcomes the force of the spring constant of spring 70, thereby causing the second ball to reseat in outlet 27.

Figure 5:
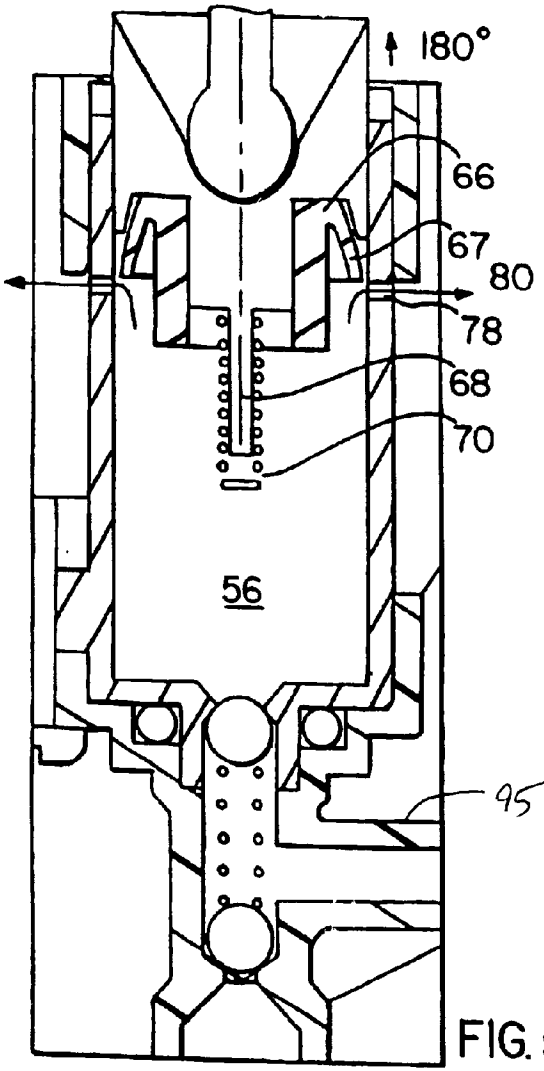
FIG. 5 is a view sequential to that of FIGS. 3 and 4 showing the piston at its maximum height and the cylinder at its lowest atmospheric pressure, which occurs when the cam is at a 180 degree position relative to the engine bracket, which represents the end of the up stroke and beginning of the down stroke.

FIG. 5 shows the point of maximum height, that is, the top of the 8.5 millimeter stroke of the engine which corresponds to the point of lowest air pressure within piston chamber housing 56. At that point, piston seal 66 will pass exhaust apertures 78 permitting escape of air from cylinder housing 56 thereby creating a relative vacuum therewith. This escaping air is shown by arrows 80.

Figure 8:
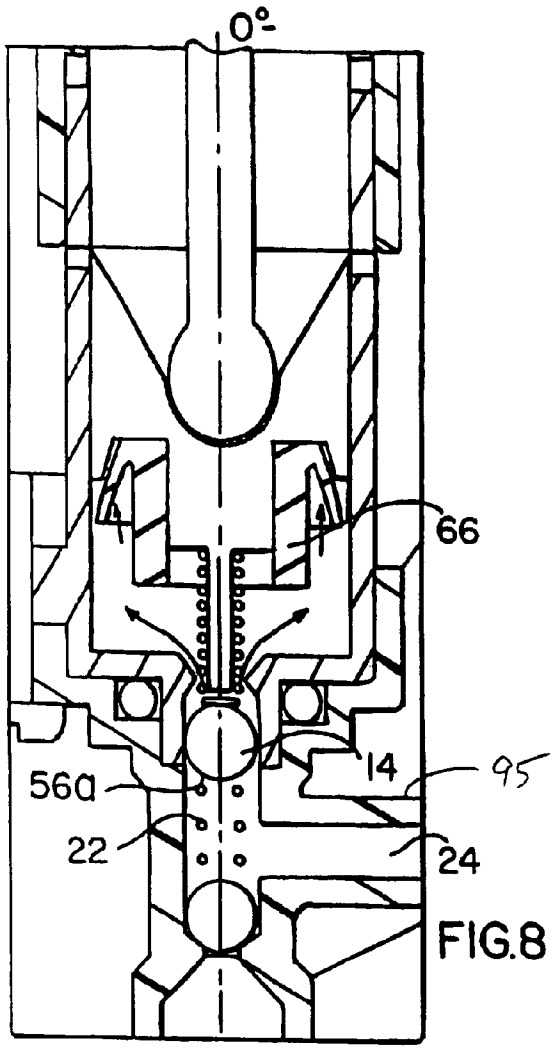
FIG. 8 is a view sequential to the view of FIG. 7 showing the completion of one engine cycle so that the piston and check valve are shown in a position an instant before their position shown in FIG. 3.
Figure 7:
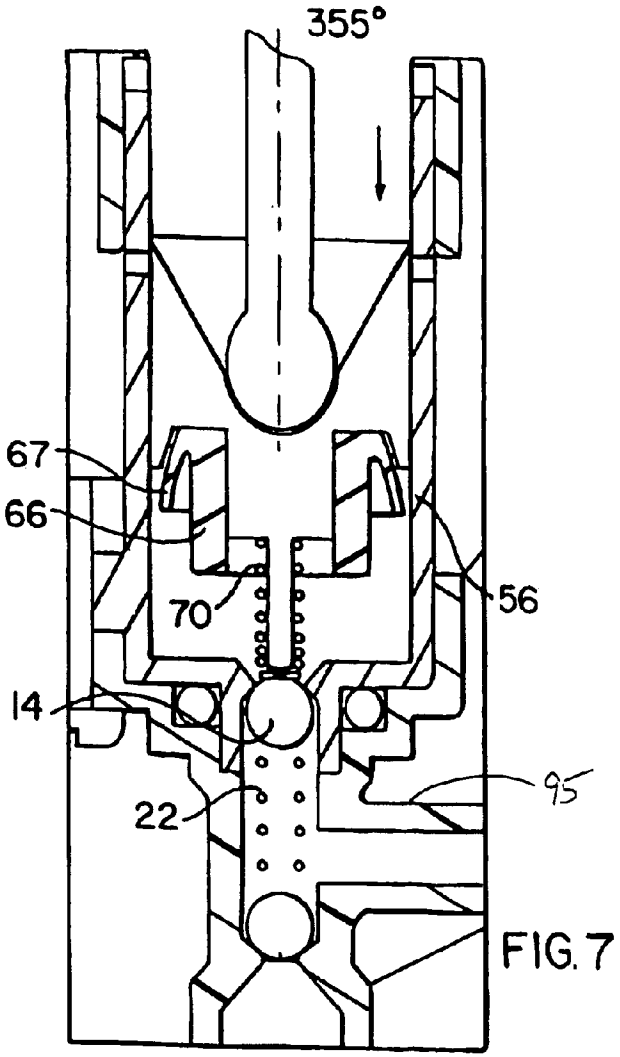
FIG. 7 is view sequential to the view of FIG. 6 showing the cam position at about 355 degrees, which is approximately the first point of contact of the proximal element of the check valve by the piston spring.

After the maximum stroke height of FIG. 5 is accomplished, the angular inertia from the propeller 105 (FIGS. 12 and 13) is transmitted through shaft 38 to cam 44 to connecting rod 52 and to piston 54. As shown in the transition from FIG. 5 to FIG. 6, this causes downward motion of the rod and piston. As this occurs, air pressure within piston chamber 56C increases as does the potential energy of spring 70. This process continues causing spring 70 to contact ball 14 at about 350 degrees. FIG. 7, which corresponds to a cam position of 355 degrees, shows a point of near maximum pressure within piston chamber 56C. The 360 degrees or zero degrees position is shown in the view of FIG. 8. At that point, as above described with reference to FIG. 3, the spring force of spring 70 overcomes the force applied by the compressed air input from pressure vessel 10 against the distal surface 56*a* of ball 14.

Summarizing this action, the power of the downstroke of the piston derives from the angular inertia of the propeller which, during a period of low cylinder pressure, is transmitted through the power shaft to the piston 54 and to the piston spring 70 during which potential energy is imparted to both said spring and to compressed air within piston chamber housing 56. Conversely, power for the upward stroke of the piston derives from a combination of the mass and energy of the compressed air input and the release of potential energy within piston spring 70, as shown in FIG. 4. Therein, the one way check valve, as actuated by piston spring 70, keeps the supply of air from the pressure vessel 10 closed for all but a brief interval during which the spring force of piston spring 70 plus the force of piston 56 overcome the air pressure against surface 56*a* of second ball 14 and the spring force of spring 22. The spring force and spring rate of piston spring 70, as well as the narrow clearance of less than a millimeter between the outside diameter of the spring and the cylinder inlet 20, taken with the conical geometry 72 of housing inlet 62, all co-act to provide a reiterating high pressure air inlet of suitable duration, thereby initiating a process of engine expansion and compression respectively using the potential energy stored within the pressure vessel 10 and spring 70.

Figure 9:
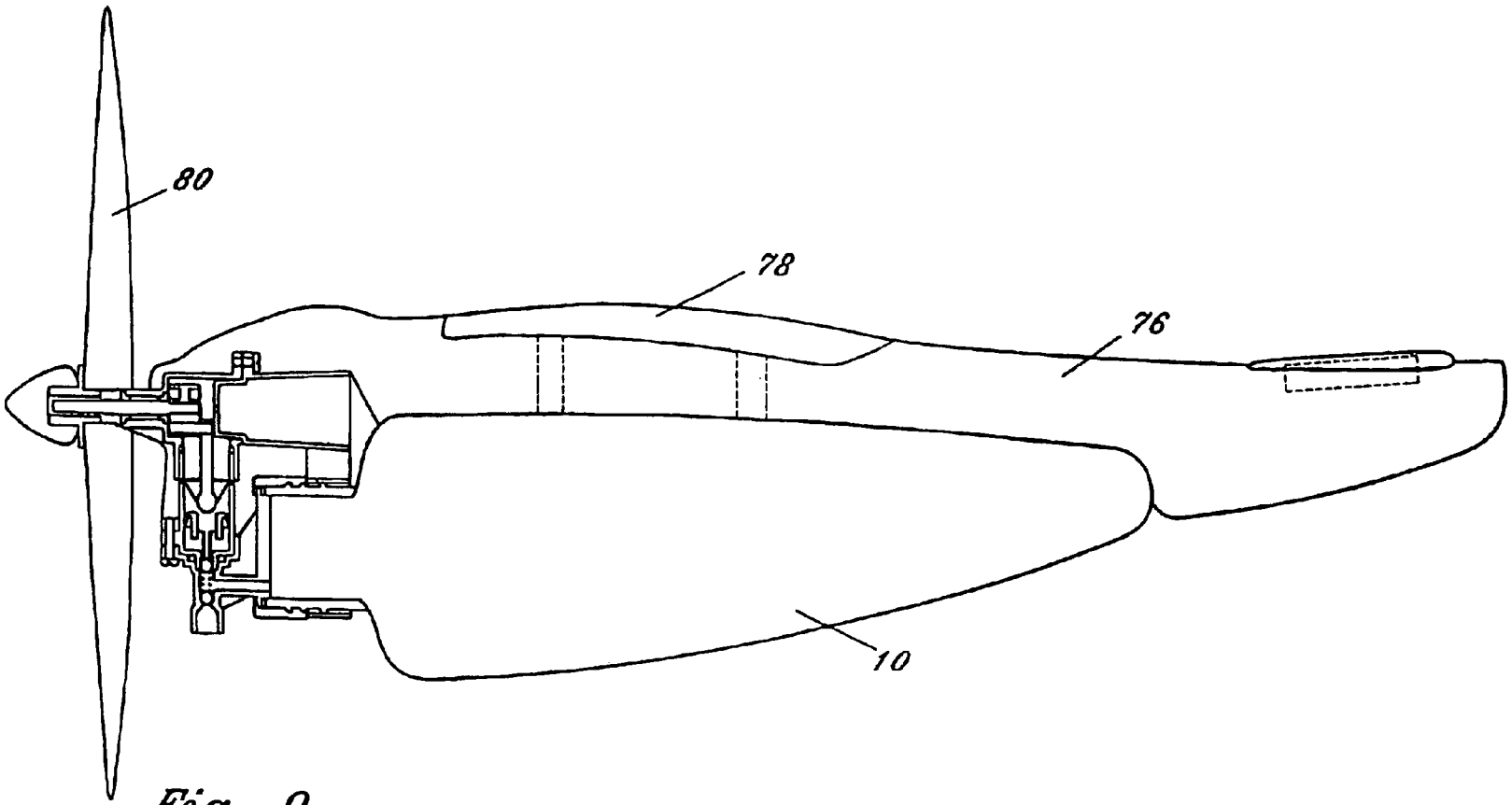
FIG. 9 is a schematic view showing the location of the engine assembly and pressure vessel relative to a vertical axial cross-section of a toy airplane.

FIG. 9 is a schematic view showing the location of the entire engine assembly, as above described, and pressure vessel 10, relative to fuselage 76, main wing 78 and propeller 80 of a model airplane equipped with the present inventive pneumatic engine.

As used in this application, directions are intended to facilitate the description of the toy vehicle of the present invention. Such terms are merely illustrative of the toy vehicle of the present invention and do not limit the invention to any specific orientation.

While advantageous embodiments have been chosen to illustrate the invention, it will be understood by those skilled in the art that various changes and modifications may be made therein without departing from the scope of the invention as defined in the appended claims.

What is claimed is:

1. A toy submarine, comprising:

a housing;

a pneumatic engine substantially disposed in said housing for powering said toy submarine;

a vessel disposed within said housing and in fluid communication with said pneumatic engine for storing air to drive said pneumatic engine;

a pump for supplying air to said vessel, said pump including a cylinder substantially disposed within said vessel;

a piston disposed in said cylinder;

a rod having first and second ends, said first end being attached to said piston to move said piston within said cylinder to supply air to said vessel; and a handle attached to said second end of said rod to move said rod, said handle being a nose of said toy submarine.

2. The toy submarine according to claim 1, wherein said air is high pressure air.

3. The toy submarine according to claim 1, wherein said vessel is a resilient polymeric plastic.

4. The toy submarine according to claim 1, wherein said handle forms a portion of said housing.

* * * * *